United States Patent [19]

Mullen

[11] Patent Number: 5,060,940

[45] Date of Patent: Oct. 29, 1991

[54] BASKETBALL SHOT RETURN DEVICE

[76] Inventor: Thomas C. Mullen, 8 Aron Dr., Woodbury, N.Y. 11797

[21] Appl. No.: 572,241

[22] Filed: Aug. 27, 1990

[51] Int. Cl.[5] ..... A63B 69/00

[52] U.S. Cl. ..... 273/1.5 A; 273/396

[58] Field of Search ..... 273/1.5 A, 396, 397; D21/201

[56] References Cited

U.S. PATENT DOCUMENTS

| | | | |
|---|---|---|---|
| 3,776,550 | 12/1973 | McNabb | 273/1.5 A |
| 3,841,631 | 10/1974 | Dolan | 273/1.5 R |
| 3,913,916 | 10/1975 | Martin, Jr. | 273/396 |
| 3,917,263 | 11/1975 | Wiley | 273/1.5 A |
| 4,579,340 | 4/1986 | Jenkins et al. | 273/1.5 A |
| 4,678,189 | 7/1987 | Koss | 273/1.5 A |
| 4,913,431 | 4/1990 | Jakobs | 273/1.5 A |

*Primary Examiner*—Paul E. Shapiro

*Attorney, Agent, or Firm*—Michael I. Kroll

[57] ABSTRACT

A basketball shot return device is provided and consists of a base member placed on a basketball court directly under a rim and net of a basketball backstop. An upstanding support member is connected onto the base member, while an upstanding chute return member is connected onto the support member. A catcher member is connected onto the chute return member and is sized to fit against the bottom of the backboard of the backstop. When a player shoots at the rim the basketball will drop into the catcher member, travel down into the chute return member and exit therefrom to be returned to the player.

5 Claims, 2 Drawing Sheets

12
18
68
62
32
70
64
66
56
58
60
50
46
30
54
52
48
44
28
40
42
36
38
26

22
20
24
10
16
34

(ROTATABLE RETURN CHUTE PERMITS BALL RETURN TO DESIRED COURT LOCATION)

BASKETBALL SHOT RETURN DEVICE

BACKGROUND OF THE INVENTION

1. Field of the Invention

The instant invention relates generally to basketball equipment and more specifically it relates to a basketball shot return device.

2. Description of the Prior Art

Numerous basketball equipment have been provided in prior art that are adapted to help the basketball players to improve their aim when they sink baskets. While these units may be suitable for the particular purpose to which they address, they would not be as suitable for the purposes of the present invention as heretofore described.

SUMMARY OF THE INVENTION

A primary object of the present invention is to provide a basketball shot return device that will overcome the shortcomings of the prior art devices.

Another object is to provide a basketball shot return device that will allow a basketball to be returned to the player at any angle therefrom.

An additional object is to provide a basketball shot return device that will allow a shot that misses the rim to be returned to the player.

A further object is to provide a basketball shot return device that is simple and easy to use.

A still further object is to provide a basketball shot return device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
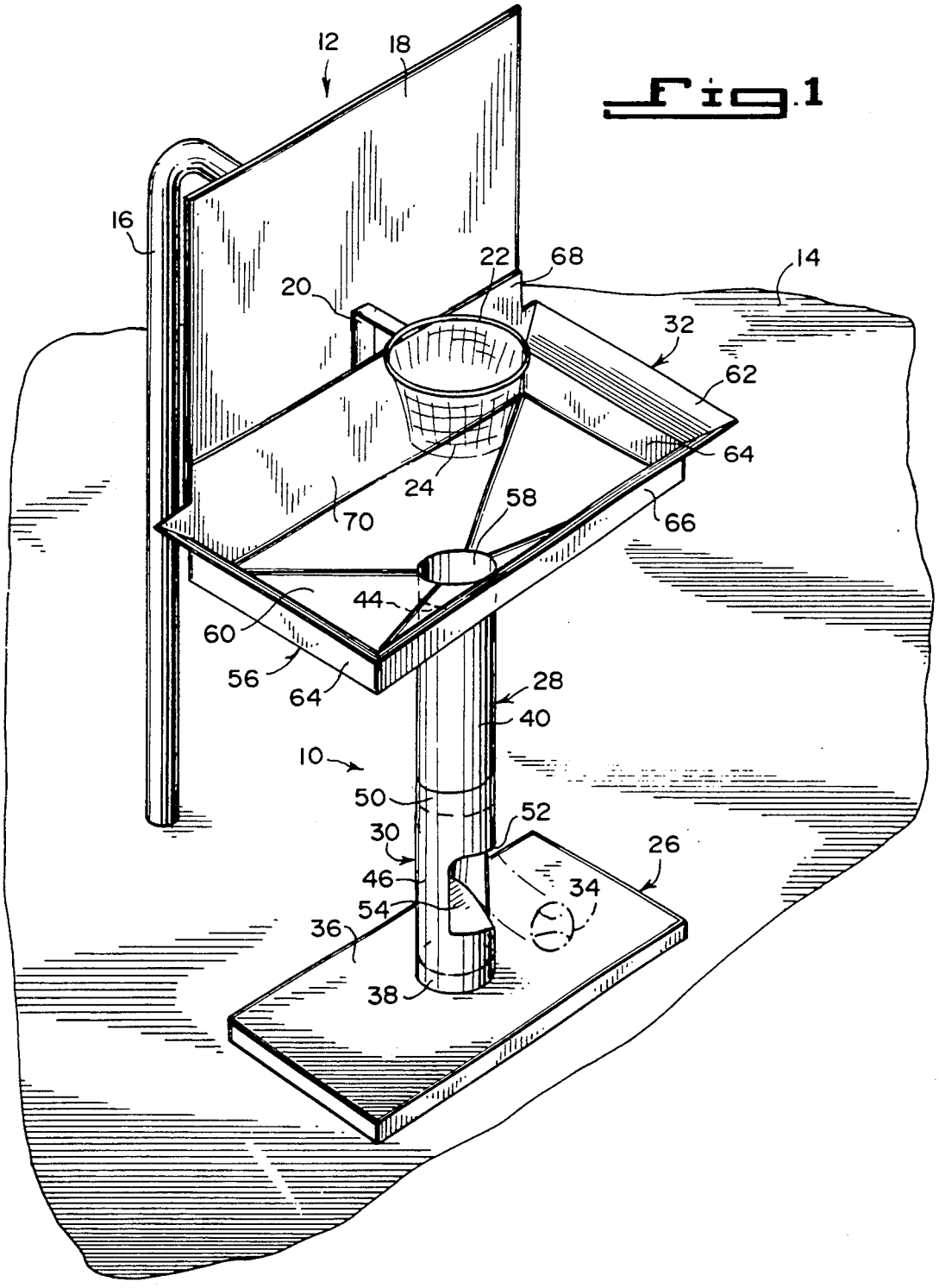
FIG. 1 is a top perspective view of the instant invention with the chute return member above the base member, positioned against the backboard of a basketball backstop.
Figures 2, 3, 4, 5, 6:
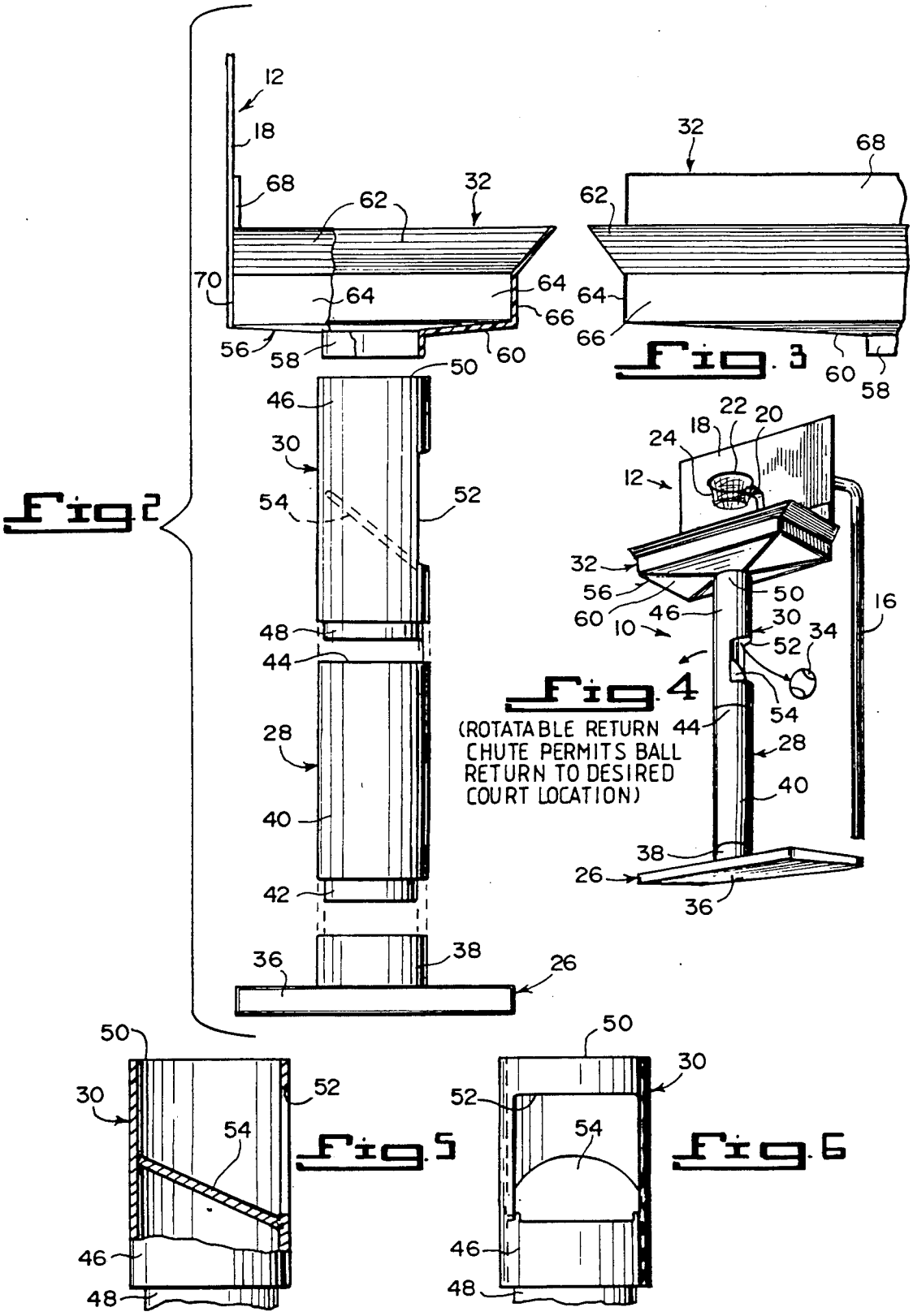
FIG. 2 is an exploded side view with parts broken away and in section with the chute return member below the catcher member.
FIG. 3 is a front view of the catcher member with parts broken away.
FIG. 4 is a bottom perspective view of the invention with the chute return member below the catcher member.
FIG. 5 is a side view of the chute return member with parts broken away and in section.
FIG. 6 is a front view of the chute return member.

Turning now descriptively to the drawings, in which similar reference characters denote similar elements throughout the several views, FIGS. 2 and 4 illustrate a basketball shot return device 10 for a basketball backstop 12 on a basketball court 14, as shown in FIG. 1. The backstop 12 is of the type having a stanchion 16, a backboard 18, a bracket 20, a rim 22 and a net 24. The device 10 consists of a base member 26 to be placed on the basketball court 14 directly under the rim 22 and net 24 of the basketball backstop 12. An upstanding support member 28 is connected onto the base member 26. An upstanding chute return member 30 is connected onto the support member 28. A catcher member 32 is connected onto the chute return member 30 and is sized to fit against the bottom of the backboard 18 of the basketball backstop 12 with the rim 22 and net 24 directly over the catcher member 32. When a player shoots at the rim 22, the basketball 34 will drop into the catcher member 32, travel down into the chute return member 30 and exit therefrom to be returned to the player.

The base member 26 includes a weighted base plate 36 to stabilize the device 10 and an upstanding female connector 38 on the base plate 36. The support member 28 includes a hollow tube 40 having a male connector 42 at the bottom end and a female connector 44 at the top end, whereby the male connector 40 can engage with the female connector 38 of the base member 26.

The chute return member 30, as best seen in FIGS. 5 and 6, includes a hollow tube 46 having a female connector 50 at the top end, a side aperture 52 and an angular deflector plate 54 positioned therein adjacent the side aperture 52 so as to bounce the basket ball 34 through the side aperture 52. The male connector 48 can engage with the female connector 44 of the support member 28.

The catcher member 32, as shown in FIGS. 2, 3 and 4, includes a rectangular tray 56 having a hollow male connector 58 at the center of a sloping bottom wall 60, an outwardly angular flange 62 about the sides 64 and front wall 66 of the tray 56 and a vertical backplate 68 extending upwardly from the back wall 70 of the tray 56 to bear against the bottom of the backboard 18 of the basketball backstop 12. When the player shoots at the rim 22, the basketball 34 will drop into the tray 56 and roll down the sloping bottom wall 60 into the hollow male connector 58, into the hollow tube 46 of the chute return member 30 onto the deflector plate 54 and out of the side aperture 52 to be returned to the player.

The support member 28 and the chute return member 30 can be interchangeably connected between the base member 26 and the catcher member 32 (see FIG. 1). The chute return member 30 can be manually rotated about its axis to change the position of the side aperture 52 so that the basketball 34 will exit therefrom to any desired court location.

LIST OF REFERENCE NUMBERS

10 basketball shot return device
12 basketball backstop
14 basketball court
16 stanchion
18 backboard
20 bracket
22 rim
24 net
26 base member
28 support member
30 chute return member
32 catcher member
34 basketball
36 weighted base plate of 26
38 female connector on 36
40 hollow tube of 28
42 male connector on 40

44 female connector on 40
46 hollow tube of 30
48 male connector on 46
50 female connector on 46
52 side aperture in 46
54 angular deflector plate in 46
56 rectangular tray of 32
58 hollow male connector in 56
60 sloping bottom wall of 56
62 outwardly angular flange in 56
64 side wall
66 front wall
68 vertical backplate in 56
70 back wall It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A basketball shot return device for a basketball backstop on a basketball court, the backstop being of the type having a stanchion, a backboard, a bracket, a rim and a net, said device comprising:

a) a base member to be placed on the basketball court directly under the rim and net of the basketball backstop;

said base member including 1) a weighted base plate to stabilize said device; and 2) an upstanding female connector on said base plate;

b) an upstanding support member connected onto said base member;

c) an upstanding chute return member connected onto said support member; and d) a catcher member connected onto said chute return member, said catcher member sized to fit against the bottom of the backboard of the basketball backstop with the rim and net directly over said catcher member so that when a player shoots at the rim the basketball will drop into said catcher member, travel down into said chute return member and exit therefrom to be returned to the player.

2. A basketball shot return device as recited in claim 1, wherein said support member includes a hollow tube having a male connector at the bottom end and a female connector at the top end, whereby the male connector can engage with the female connector of said base member.

3. A basketball shot return device as recited in claim 2, wherein said chute return member includes a hollow tube having a male connector at the bottom end, a female connector at the top end, a side aperture and an angular deflector plate positioned therein adjacent the side aperture so as to bounce the basketball through the side aperture, whereby the male connector can engage with the female connector of said support member.

4. A basketball shot return device as recited in claim 3, wherein said catcher member includes a rectangular tray having a hollow male connector at the center of a sloping bottom wall, an outwardly angular flange about the sides and front wall of the tray and a vertical backplate extending upwardly from the back wall of the tray to bear against the bottom of the backboard of the basketball backstop so that when the player shoots at the rim the basketball will drop into the tray and roll down the sloping bottom wall into the hollow male connector, into the hollow tube of said chute return member onto the deflector plate and out of the side aperture to be returned to the player.

5. A basketball shot return device as recited in claim 4, wherein said support member and said chute return member can be interchangeably connected between said base member and said catcher member and said chute return member can be manually rotated about its axis to change the position of the side aperture so that the basketball will exit therefrom to any desired court location.

* * * * *